US008277645B2

(12) United States Patent
Jarvis, Jr. et al.

(10) Patent No.: US 8,277,645 B2
(45) Date of Patent: Oct. 2, 2012

(54) AUTOMATIC RETRACTABLE SCREEN SYSTEM FOR STORM DRAIN INLETS

(76) Inventors: Ernest Jarvis, Jr., Norco, CA (US); Rafael Padilla, Yucaipa, CA (US)

( * ) Notice: Subject to any disclaimer, the term of this patent is extended or adjusted under 35 U.S.C. 154(b) by 198 days.

(21) Appl. No.: 12/639,262

(22) Filed: Dec. 16, 2009

(65) Prior Publication Data

US 2010/0147752 A1 Jun. 17, 2010

Related U.S. Application Data

(60) Provisional application No. 61/138,218, filed on Dec. 17, 2008.

(51) Int. Cl.
*E03F 5/14* (2006.01)

(52) U.S. Cl. ..... 210/131; 210/156; 210/162; 210/163; 404/4

(58) Field of Classification Search ..... 210/131, 210/156, 162, 163, 170.03; 404/4, 5
See application file for complete search history.

(56) References Cited

U.S. PATENT DOCUMENTS

| | | | |
|---|---|---|---|
| 73,159 | A | 1/1868 | Besse |
| 171,567 | A | 12/1875 | Huffaker |
| 314,865 | A | 3/1885 | Monger |
| 316,854 | A | 4/1885 | Van Auken |
| 440,067 | A | 11/1890 | Smith |
| 911,290 | A | 2/1909 | Burkett |
| 930,829 | A | 8/1909 | Bolling |
| 1,143,496 | A | 6/1915 | Briles |
| 1,220,123 | A | 3/1917 | Heybach |
| 1,245,903 | A | 11/1917 | Gross |
| 1,382,589 | A | 6/1921 | Ziegler |
| 2,198,943 | A | 4/1940 | Lowe |
| 4,418,432 | A | 12/1983 | Vidal |
| 4,935,129 | A | 6/1990 | Wang |
| 5,788,849 | A | 8/1998 | Hutter, Jr. |
| 5,944,445 | A | 8/1999 | Montgomery |
| 6,015,489 | A | 1/2000 | Allen |
| 6,217,756 | B1 | 4/2001 | Martinez |
| 6,287,050 | B1 | 9/2001 | Montgomery |
| 6,390,730 | B1 | 5/2002 | Scheibe |
| 6,478,954 | B1 | 11/2002 | Turner, Jr. |
| 6,485,231 | B2 | 11/2002 | Montgomery et al. |
| 6,623,209 | B1 | 9/2003 | Waters, Jr. |
| 6,733,665 | B1 | 5/2004 | Khalil |
| 6,821,053 | B2 | 11/2004 | Martinez |

(Continued)

FOREIGN PATENT DOCUMENTS

| | | | |
|---|---|---|---|
| EP | 00086749 | B1 | 4/1986 |

(Continued)

*Primary Examiner* — Christopher Upton
(74) *Attorney, Agent, or Firm* — Karish & Bjorgum, P.C.

(57) ABSTRACT

A screen system having first and second side members, each having a locking gear reversibly movable from a locked position to an unlocked position. A screen is coupled to the side members. The screen has openings and is rotatable from a closed position to an open position. The screen is engagable with the locking gears to preventing the screen from rotating from the closed position to the open position. A trigger plate is movably coupled to the screen, rotates from a first position to a second position and is engagable with the locking gears to prevent the locking gears from moving from the locked position to the unlocked position. The trigger plate disengages with the locking gears when water flows against it, allowing the locking gears to move from the locked position to the unlocked position and the screen to rotate from the closed position to the open position.

21 Claims, 13 Drawing Sheets

U.S. PATENT DOCUMENTS

| | | | | |
|---|---|---|---|---|
| 6,972,088 | B2 | 12/2005 | Yehuda | |
| 7,083,359 | B2 | 8/2006 | Aughton | |
| 7,234,894 | B1 | 6/2007 | Flury | |
| 7,238,279 | B2 * | 7/2007 | Saurenman et al. | 210/163 |
| 7,467,911 | B2 | 12/2008 | Flury | |
| 7,951,291 | B2 * | 5/2011 | Nino | 210/156 |
| 2004/0009041 | A1 | 1/2004 | Aughton | |
| 2004/0069697 | A1 | 4/2004 | Martinez | |
| 2004/0173513 | A1 | 9/2004 | Nino | |
| 2006/0083592 | A1 | 4/2006 | Aughton | |
| 2008/0014021 | A1 | 1/2008 | Flury | |
| 2008/0226390 | A1 | 9/2008 | Nino | |
| 2009/0236293 | A1 * | 9/2009 | Alvarado | 210/131 |

FOREIGN PATENT DOCUMENTS

| | | | |
|---|---|---|---|
| EP | 00087548 | B1 | 10/1986 |
| EP | 00197372 | A2 | 10/1986 |
| EP | 00143072 | B1 | 10/1987 |
| EP | 00132775 | B1 | 12/1987 |
| EP | 00179960 | B1 | 12/1988 |
| EP | 00195364 | B1 | 12/1988 |
| EP | 00118021 | B1 | 1/1989 |
| EP | 00343435 | B1 | 8/1991 |
| EP | 00403546 | B1 | 11/1991 |
| EP | 00276861 | B1 | 4/1992 |
| EP | 00443205 | B1 | 7/1992 |
| EP | 00374170 | B1 | 6/1994 |
| EP | 00458224 | B1 | 9/1994 |
| EP | 00439568 | B1 | 11/1994 |
| EP | 00476672 | B1 | 1/1995 |
| EP | 00674057 | A1 | 9/1995 |
| EP | 00627530 | B1 | 3/1997 |
| EP | 00619131 | B1 | 6/1997 |
| EP | 00682155 | B1 | 9/1997 |
| EP | 00604432 | B1 | 4/2001 |
| EP | 01188863 | A1 | 3/2002 |
| EP | 01359255 | A2 | 11/2003 |
| EP | 01411172 | A2 | 4/2004 |
| EP | 01311728 | B1 | 5/2007 |
| EP | 01415051 | B1 | 9/2007 |
| WO | 9100940 | A1 | 1/1991 |
| WO | 9842927 | A1 | 10/1998 |
| WO | 0026476 | A1 | 5/2000 |
| WO | 2006053562 | A1 | 5/2006 |
| WO | 2008064420 | A1 | 6/2008 |

* cited by examiner

AUTOMATIC RETRACTABLE SCREEN SYSTEM FOR STORM DRAIN INLETS

CROSS REFERENCE TO RELATED APPLICATION

This application claims priority of U.S. Provisional Patent Application No. 61/138,218, filed on Dec. 17, 2008, entitled AUTOMATIC RETRACTABLE SCREEN SYSTEM FOR STORM DRAIN INLETS, the entire contents of which are hereby incorporated herein by reference.

BACKGROUND OF THE INVENTION

This invention relates generally to retractable screen systems for installation across a storm drain inlet, and particularly, to a retractable screen system for installation across a storm drain inlet that is locked in a closed position during dry periods and when water runoff levels are low, and which automatically retracts to an open position when water runoff reaches a predetermined level.

The storm drain system is a vast network of underground pipes and open channels that were designed to prevent flooding of city streets. Rain water and ground water runoff drains from the street into the gutter and enters the storm drain system through an opening in the curb called a storm drain inlet or a catch basin. Curbside storm drain inlets serve as the primary entry point for urban runoff water into the storm drain system.

A storm drain inlet is designed to drain excess rain and ground water from streets, parking lots, sidewalks, and roofs. Storm drains inlets vary in size and design from small residential dry wells to large municipal systems. The storm drain inlets receive water from street gutters on most motorways, freeways and other busy roads. Storm drain inlets are also often found in towns and areas which frequently experience heavy rainfall, flooding, and storms.

Most storm drain inlets are provided with gratings or grids to prevent various large objects from falling into the storm drain system. The bars of the typical gratings are fairly widely spaced so as to not impede the flow of water into the storm drain inlet. As a result, various small objects, including many types of common environmental debris, pollutants, and trash, such as aluminum cans, styrofoam and plastic cups, paper wrappers, plastic bags, etc., regularly fall into the storm drain inlet opening. If not caught by the catch basin, or sump, which typically lies immediately below the grating, these environmental debris and pollutants often end up in the storm drain system and in the body of water to which the storm drain system leads, for example, an ocean, a river, etc.

Various storm drain inlet covers or gates configured to prevent smaller types of environmental debris, trash, and pollutants from entering the storm drain system are known in the art. Typically, such covers are in the form of a plate having a plurality of perforations or a mesh-like configuration designed to block out small objects. Some of the known covers are permanently attached to the storm drain curb inlet opening and stay closed irrespective of water runoff levels. Some examples of such covers are disclosed in, for example, U.S. Pat. No. 4,594,157 to McGowan and U.S. Pat. No. 7,179,371 to Bistline. One disadvantage of such covers is that when debris, trash, or the like accumulate in front of, or attach to these storm drain covers, the openings in the cover are blocked and no longer permit water to drain from the street thereby leading to possible flooding.

Some of the known storm drain covers stay closed to prevent smaller-sized environmental debris, pollutants, and trash from entering the storm drain system during dry periods and periods when water runoff levels are low, but when water flow becomes stronger or when levels rise, water interacts with the mechanical parts of such cover systems and causes the covers to swing open.

When the storm drain covers open, water is permitted to flow unimpeded into the catch basin through the storm drain curb inlet. With the storm drain cover open, debris and trash are permitted to enter the catch basin through the storm drain inlet along with water runoff. However, conventional street sweepers typically collect debris and trash accumulated on the streets and adjacent the storm drain inlets on a weekly basis. Since the storm drain covers are closed during dry and low water level periods, the storm drain covers provide for the removal of a large percentage of debris and trash during street sweeping operations, preventing such trash and debris from entering the storm drain system when the storm drain covers open in response to higher water levels.

Some of the known storm drain cover systems designed to remain closed during dry periods or periods of low water flow to block out environmental debris and pollutants and to open during periods of increased water flow or water levels are disclosed in, for example, U.S. Publication No. 2004/0069697 to Martinez, U.S. Publication No. 2004/0173513 to Nino, U.S. Publication No. 2008/0014021 to Flury, U.S. Pat. No. 6,972,088 to Yehuda, U.S. Pat. No. 7,234,894 to Flury, and U.S. Pat. No. 7,238,279 to Saurenman et al. One disadvantage of such systems is that a large number of complex mechanical components are employed in the mechanism that causes the storm drain cover to open. Systems using a large number of mechanical parts are costly to build, install, and maintain. In addition, the more mechanical parts used in a storm drain cover system, the higher the likelihood that one of the system components breaks or malfunctions.

Additionally, other known retractable screen systems, such as those disclosed in, for example, U.S. Pat. No. 7,467,911 to Flury, utilize springs to control movement of the screen. Springs are disfavored for use in the sewer environment, are difficult to calibrate properly and can fatigue over time, and therefore increase the likelihood of system malfunction.

Thus, there exists a need for a retractable screen system for use with storm drain inlets that is simple in design, includes a relatively small number of parts, and does not depend on complex mechanical interactions to translate the action of water into the rotation of the storm drain cover to the open position.

SUMMARY OF INVENTION

The invention satisfies this need. The invention is a retractable screen system for installation across a storm drain inlet. The retractable screen system permits water to flow therethrough and prevents solid objects of predetermined size and shape from passing therethrough into the storm drain inlet.

In a preferred embodiment of the present invention, the system comprises a frame comprising: a first side member; and a second side member opposite the first side member. Each of the first and second side members comprises a locking gear. Each of the gears is configured to be reversibly movable from a locked position to an unlocked position. The system further comprises a retractable screen movably coupled to the first and second frame side members. The screen comprises a plurality of openings and is configured to rotate from a closed position to an open position. At least a portion of the retractable screen is removably engagable with the locking gears. The locking gears prevent the screen from rotating from the closed position to the open position when the locking gears are in the locked position.

The system further comprises a trigger plate movably coupled to the screen. The trigger plate is configured to rotate from a first position to a second position. At least a portion of the trigger plate is removably engagable with the locking gears. The trigger plate prevents the locking gears from moving from the locked position to the unlocked position when the trigger plate is in the first position. The trigger plate is configured to move out of engagement with the locking gears when water flows against a portion of the trigger plate, allowing the locking gears to move from the locked position to the unlocked position and permitting the screen to rotate from the closed position to the open position.

In one preferred embodiment, the trigger plate includes a plurality of projections and each of the locking gears includes at least one recess. At least one of the trigger plate projections is retained in the at least one recess of the locking gears to prevent the locking gears from moving from the locked position to the unlocked position when the trigger plate is in the first position.

In one preferred embodiment, the trigger plate and the retractable screen each include a plurality of projections extending therefrom and the first and second frame side members include a plurality of elongated openings therein. At least one of the projections of the trigger plate and at least one of the projections of the retractable screen move in a generally upward direction in the elongated openings when the retractable screen rotates from the closed position to the open position. Optionally, at least one of the elongated openings includes a curved portion.

In one preferred embodiment, when the screen rotates from the open position to the closed position the screen projections and the trigger plate projections engage the locking gears to lock the screen in the closed position. Additionally, each of the first and second frame side members may include at least one set pin configured to abut a portion of the locking gear to restrict a maximum degree of rotation of the locking gear.

In one preferred embodiment, they system further comprises a first top member is secured to each of the first and second frame side members. The first top member may includes a flange configured to deflect water flow onto a portion of the trigger plate. Additionally, the system may have a second top member secured to each of the first and second side members. At least a portion of the second top member being may be configured to abut a portion of the screen when the screen is in a fully open position.

In one preferred embodiment, the trigger plate rotates in a generally upward direction when water flows against a portion of the trigger plate to allow the locking gears to move into the unlocked position. In one preferred embodiment, the screen further comprises an adjustable screen extension. In one preferred embodiment, the trigger plate further comprises an adjustable trigger plate extension.

In one preferred embodiment, the system comprises a frame having a first side and a second side opposite the first side, each of the first and second sides including a locking gear configured to rotate from a locked position to an unlocked position. Each of the locking gears includes a first recess and a second recess. The system further comprises a retractable screen rotatably coupled to the first and second frame sides. The screen is configured to rotate from a closed position to an open position. The screen includes a plurality of openings; and a plurality of projections extending therefrom. At least one of the screen projections is retained in the first recess of each of the locking gears when the screen is in the closed position and the locking gears are in the locked position.

The system further comprises a trigger plate rotatably coupled to the screen. The trigger plate is configured to rotate from a first position to a second position. The trigger plate has a plurality of projections extending therefrom, separate projections being retained in the second recess of each of the locking gears when the trigger plate is in the first position and the locking gears are in the locked position. When water flows against a portion of the trigger plate, the trigger plate rotates and the projections of the trigger plate move out of the second recess of each of the locking gears, allowing the locking gears to rotate from the locked position to the unlocked position to permit the projections of the screen to move out of the first recess of each of the locking gears and for the screen to rotate from the closed position to the open position.

In one preferred embodiment, the retractable screen system for installation across a storm drain inlet comprises a frame having a first side member and a second side member opposite the first side member. The system further includes a retractable screen rotatably coupled to the first and second frame side members, the retractable screen being configured to rotate from a closed position to an open position. The retractable screen has a plurality of openings permitting water to flow therethrough.

They system further includes a trigger plate coupled to the retractable screen. The trigger plate is configured to move from a first position to a second position. The retractable screen is prevented from rotating from the closed position to the open position when the trigger plate is in the first position. The trigger plate is configured to move in a generally upward direction from the first position to the second position when water flows through the screen openings and against a portion of the trigger plate. The screen is permitted to rotate from the closed position to the open position when the trigger plate is in the second position.

In a preferred embodiment, the system further comprises at least one locking member configured to engage a portion of the screen to lock the retractable screen in the closed position, the locking member being reversibly moveable from a locked position to an unlocked position. Upon movement of the trigger plate from the first position to the second position, the at least one locking member moves to the unlocked position to unlock the retractable screen and permit the retractable screen to rotate from the closed position to the open position.

BRIEF DESCRIPTION OF THE DRAWINGS

The features, aspects and advantages of the present invention will become better understood with regard to the following description, appended claims and accompanying figures wherein:

DETAILED DESCRIPTION OF THE PREFERRED EMBODIMENTS

In the following description of the preferred embodiments, reference is made to the accompanying drawings which show by way of illustration specific embodiments in which the invention may be practiced. Wherever possible, the same reference numbers will be used throughout the drawings to refer to the same or like parts. It is to be understood that other embodiments may be utilized and structural and functional changes may be made without departing from the scope of the present invention.

Figure 1:
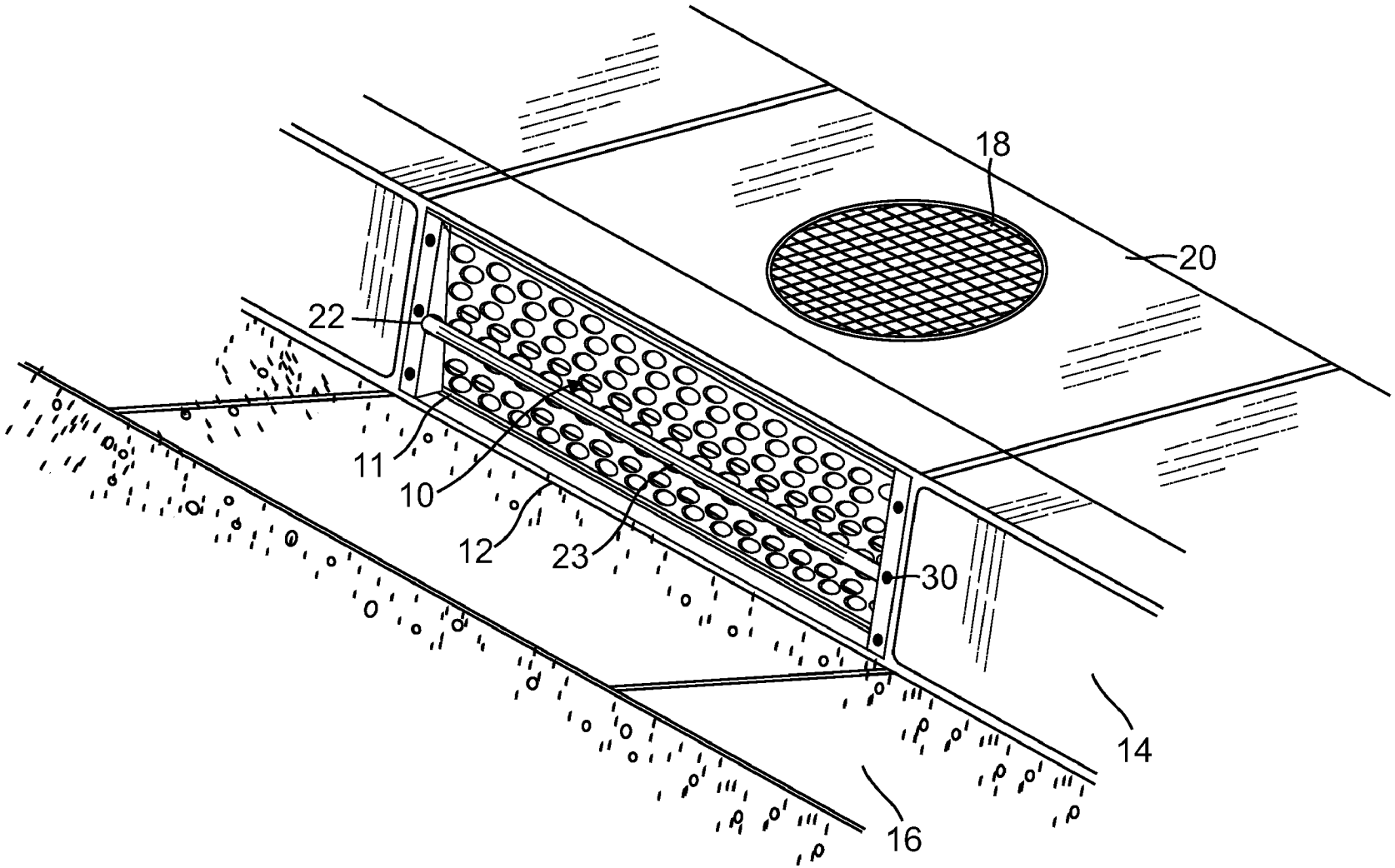
FIG. 1 is a perspective view of a first embodiment of the retractable screen system of the present invention installed across a typical storm drain inlet in a curb.

The present invention is a retractable screen system for placement across a storm drain curb inlet. FIG. 1 illustrates a first embodiment of the retractable screen system 10 of the present invention installed across a conventional storm drain inlet 12 formed in a curb 14 of a typical street 16. A manhole cover 18 in a sidewalk 20 provides access to a storm drain catch basin (not shown). In the first embodiment, the retractable screen system 10 includes a pair of openings 22 which contain a portion of a child safety bar 23 which extends across the storm drain inlet 12 to prevent children from accessing the catch basin through the storm drain inlet 12.

Figure 2A:
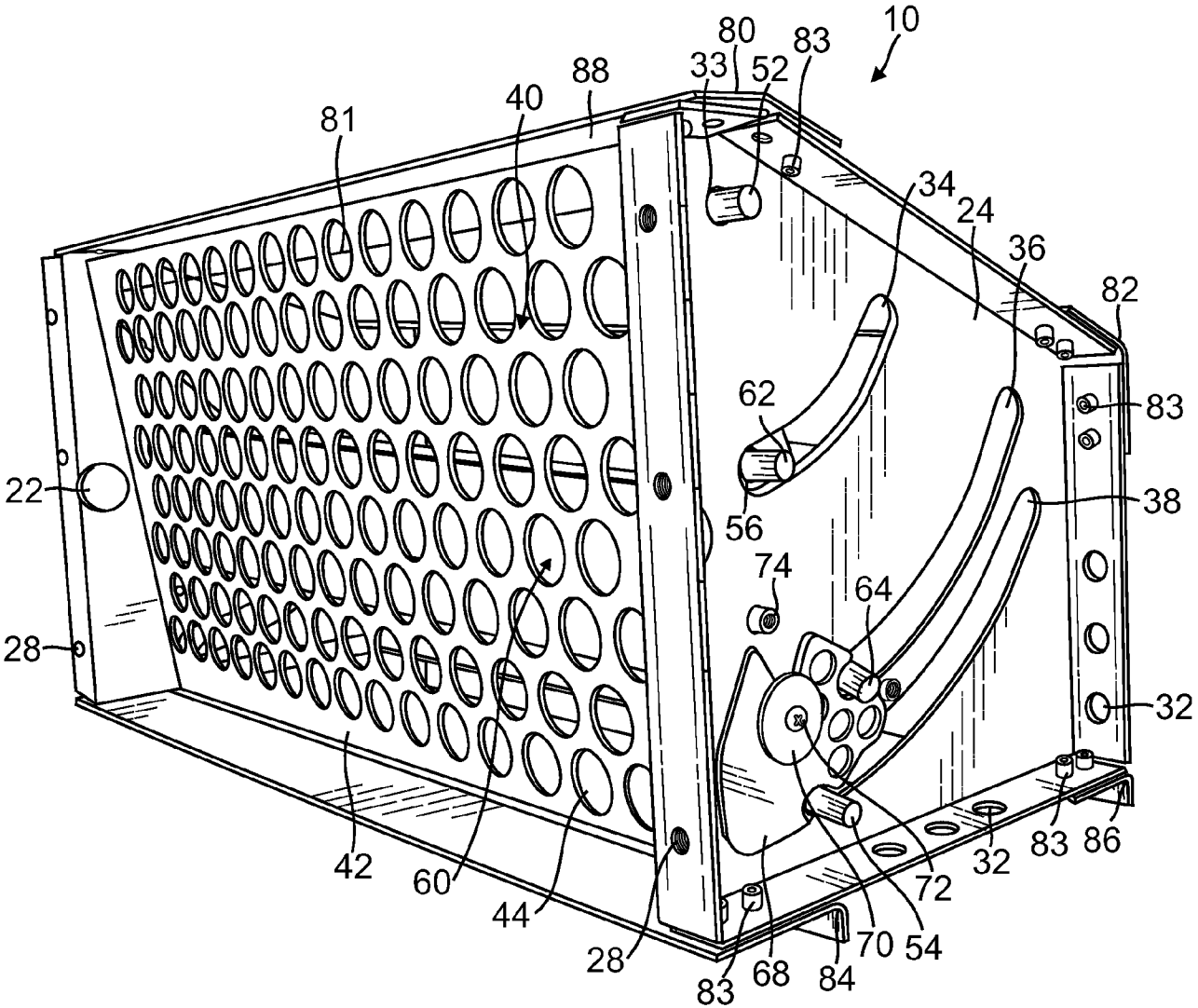
FIG. 2A is a perspective view of the retractable screen system of FIG. 1 with the screen in a closed position.

FIG. 2A shows a perspective view of the first embodiment of the retractable screen system 10 of the present invention. The screen system 10 has a frame with a first frame side member 24 and a second frame side member 26 opposite the first frame side member 24. It is to be appreciated that first and second frame side members 24, 26 of the present invention do not have to be attached to each other to form parts of a frame and could be separate and distinct members that are directly attached to the top, bottom and side walls of the storm drain inlet opening and/or the walls of the catch basin. However, in the first embodiment of the invention illustrated in the drawings, the retractable screen system 10 is in the form of a structure having a frame so as to facilitate the installation of the system across the storm drain inlet opening. Since the first and second frame side members 24, 26 may be separate members or side walls of a unitary structure, first and second frame side members 24, 26 are also interchangeably referred to hereinbelow as first and second sides, first and second side members, or first and second side walls.

In the first embodiment, the first and second frame side members 24, 26 each have a plurality of openings. Specifically, as shown in FIG. 2A, the first and second frame side members 24, 26 each have three fastener receiving openings 28. The fastener receiving openings 28 are configured to receive a fastener 30, such as a screw or bolt, therethrough. As shown in FIG. 2A, the fastener receiving openings 28 are located at the front face of the frame of the retractable screen system 10.

Referring to FIG. 1, screws 30 are typically used to secure the retractable screen system 10 to the storm drain inlet 12 from the front or street side. In an embodiment, three screws 30 on each one of the first and second frame sides 24, 26 are used to attach the retractable screen system 10 to the storm drain inlet 12. Preferably, screws 30 are one way tamper resistant stainless steel screws. It will be understood that the number of screws 30 is shown for purposes of illustration only and the number of screws may differ as appropriate for a particular storm drain inlet 12. Additionally, screws 30 may be replaced with other acceptable fasteners.

If a manhole, such as manhole 18, is available adjacent the storm drain inlet 12, the retractable screen system 10 can be secured to the storm drain inlet 12 or the catch basin using a combination of side wall mounting brackets and vertical bars (not shown) with bolts and concrete wedge anchors (not shown). As shown in FIG. 2A, in the first embodiment, the first and second frame sides 24, 26 include a plurality of openings 32 configured to receive bolts, screws, wedge anchors and the like for attachment of the retractable screen system 10 to a storm drain inlet 12 or a catch basin top, bottom, or side walls. Preferably, the screws, bolts, and nuts used to attach the retractable screen system 10 to a storm drain inlet 12 are treated with an adhesive, such as Loctite® Red thread locker adhesive, to provide a more secure attachment.

Figure 4:
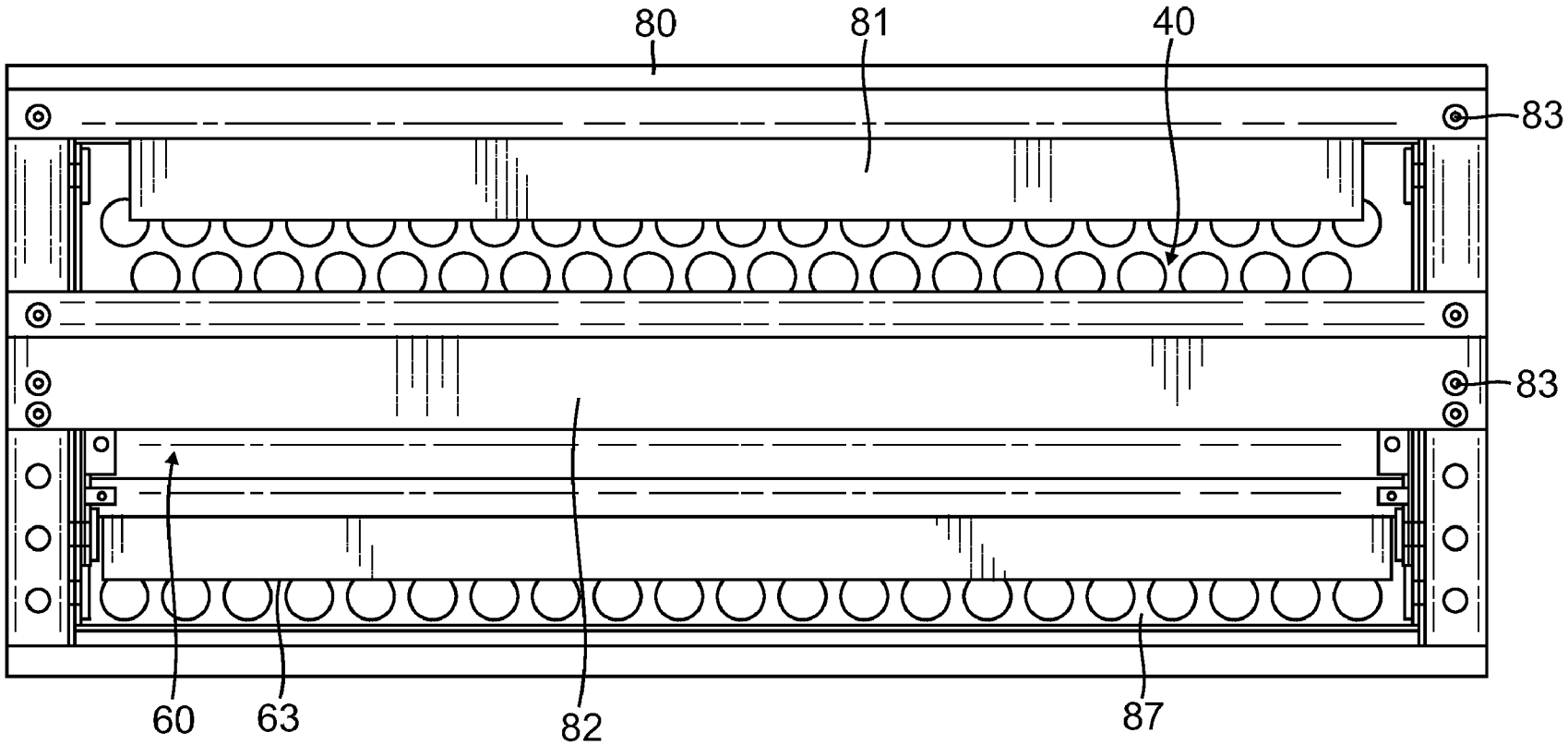
FIG. 4 is a rear view of the retractable screen system of FIG. 1 with the gate in a closed position.
Figure 5A:
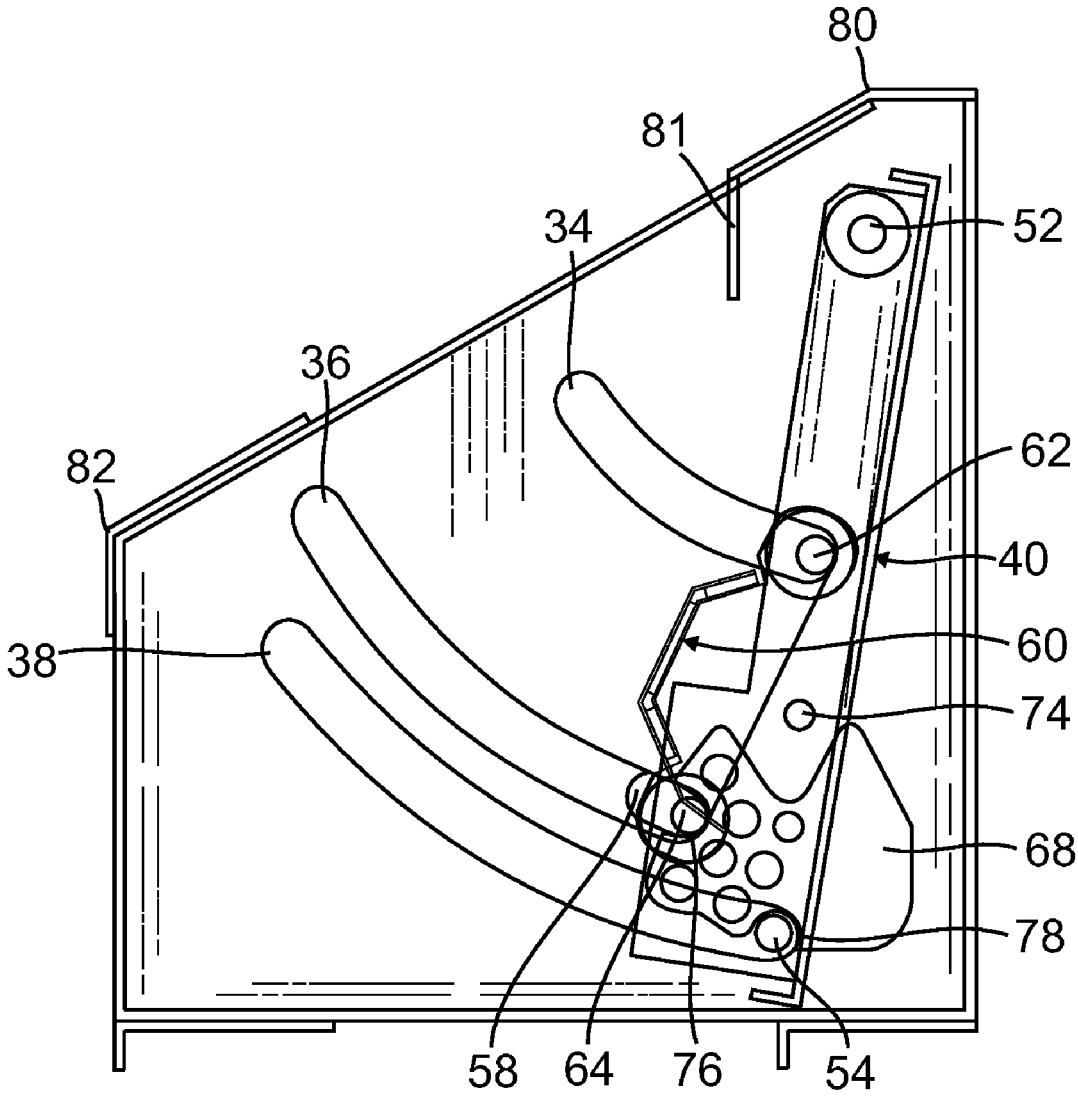
FIG. 5A is a side view of the retractable screen system of FIG. 1 with the screen in a closed position and with the locking gear in a locked position.

Referring to FIG. 2A, the retractable screen system 10 includes a first top frame member 80 and a second top frame member 82. In the first embodiment, the first top frame member 80 is positioned proximate a front face of the frame and the second top frame member 82 is positioned proximate a rear of the frame. The first and second top frame members 80, 82 each extend between and are mounted on the first and second frame side members 24, 26. Referring to FIGS. 4 and 5A, the first top frame member 80 includes a flange 81 that extends from the first top frame member 80 in a downward direction. In an embodiment, the first top frame member 80 is mounted on the first and second frame sides 24, 26 using four dome head rivets 83 and the second top frame member 82 is mounted on the first and second frame sides 24, 26 using eight dome head rivets 83. The first and second top frame members 80, 82 may also be in part welded to a portion of the first and second frame sides 24, 26. Alternatively, the first and second top frame members 80, 82 may be fully welded or integrally formed with the first and second frame sides 24, 26 such that the use of dome head rivets is eliminated.

In one preferred embodiment of the invention, as shown in FIG. 2A, the retractable screen system 10 further includes a first bottom frame member 84 and a second bottom frame member 86. The first and second bottom frame members 84, 86 extend between and are mounted to the first and second frame sides 24, 26. Preferably, the first and second bottom frame members 84, 86 are each mounted to the first and second frame sides 24, 26 using four dome head rivets 83. First and second bottom frame members 84, 86 may also be in part welded to a portion of the first and second frame sides 24, 26. Alternatively, the first and second bottom frame members 84, 86 may be fully welded or integrally formed with the first and second frame sides 24, 26 such that the use of dome head rivets 83 is eliminated. It is to be appreciated that the number of dome head rivets used to attach the first and second top frame members 80, 82, and the first and second bottom frame members 84, 86 to the first and second frame sides 24, 26 is shown for illustration purposes only, and that a different number of dome head rivets 83 may be used instead. It is also to be appreciated that dome head rivets 83 are used by way of example only as a means for attaching the first and second top frame members 80, 82, and the first and second bottom frame members 84, 86 to first and second frame sides 24, 26, and that other rivets or fasteners may be used instead.

Referring to FIG. 2A, in the first embodiment of the present invention, the first and second frame sides 24, 26 each include an opening 33 proximate a top of the first and second frame sides 24, 26. Preferably, openings 33 are circular in shape to permit a cylindrical rod to rotate therein. In the first embodiment, the first and second frame sides 24, 26 further include three elongate openings or slots 34, 36, 38. Each of the slots 34, 36, 38 is configured to receive a portion of a projection, a rod, or a bar that is permitted to move along the length of the slots 34, 36, 38.

Figure 2B:
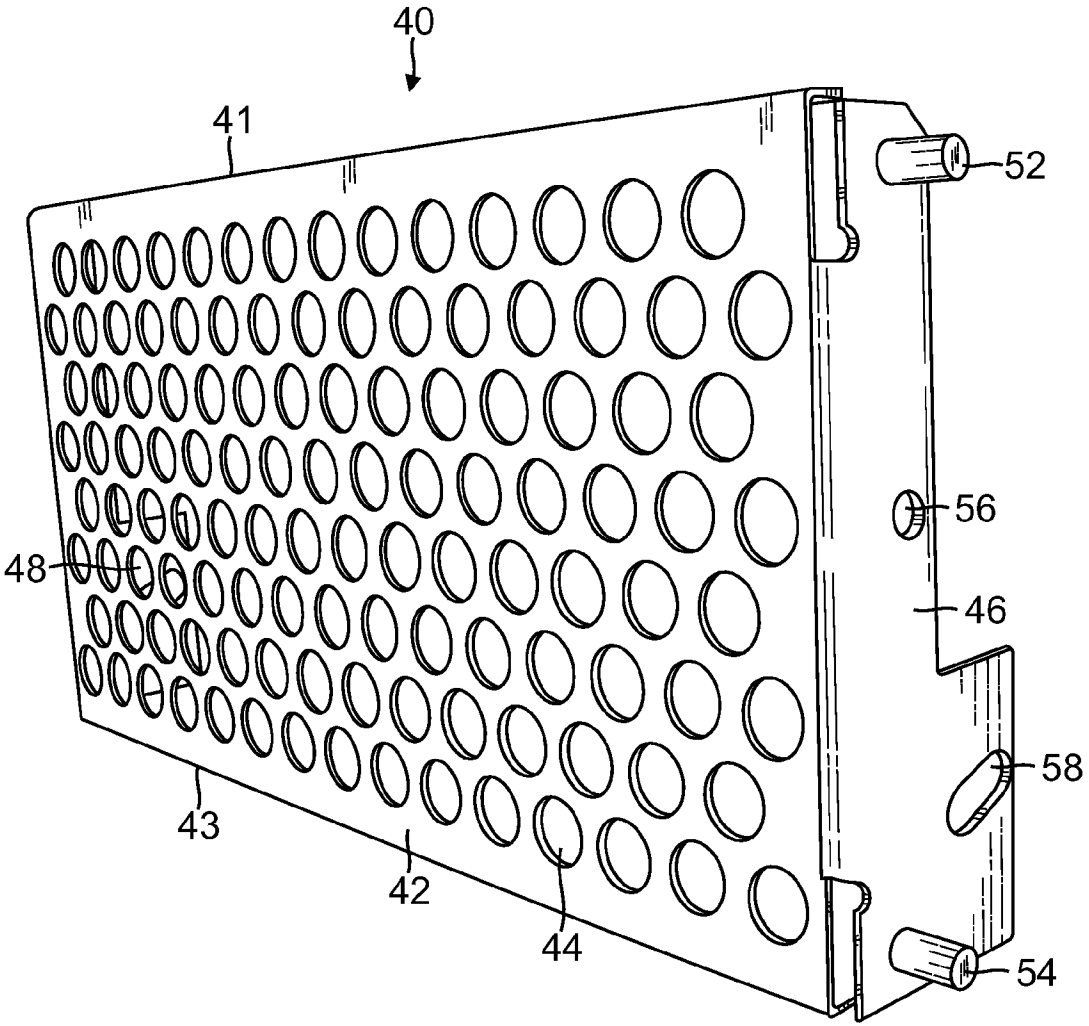
FIG. 2B is a perspective view of the retractable screen of the retractable screen system of FIG. 1.

In the first embodiment, the retractable screen system 10 further includes a screen 40 rotatably mounted to the first and second frame sides 24, 26. Referring to FIG. 2B, the screen 40 has a top 41, a bottom 43, and a face portion 42. The face portion includes a plurality of openings 44. The openings 44 permit storm water and ground water to flow therethrough. In the first embodiment, the openings 44 have a sufficiently small dimension to prevent many types of common environmental debris, trash, and pollutants from passing through the screen 40 when the screen 40 is in a closed position as shown in FIG. 1. Preferably, the screen openings 44 are circular. However, the screen openings 44 may have various other shapes.

Figure 3:
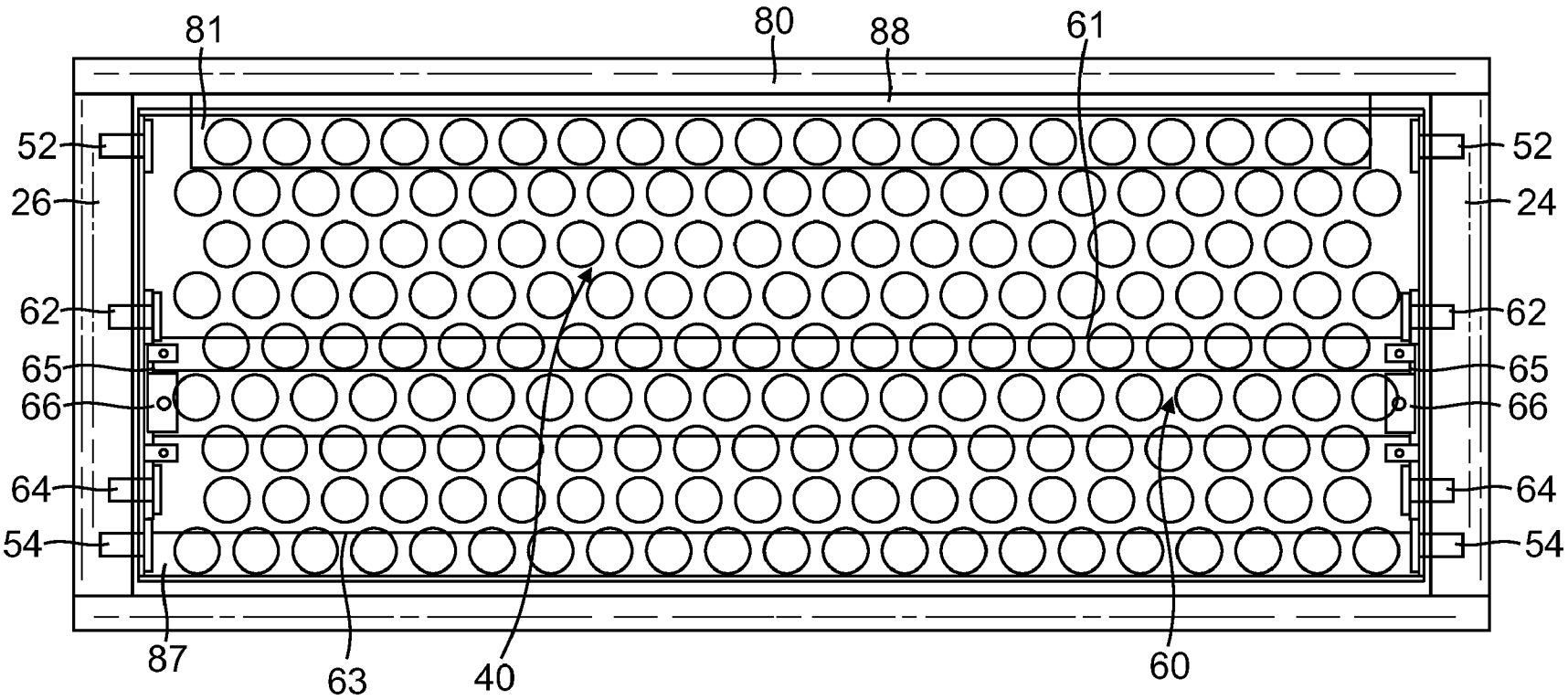
FIG. 3 is a front elevation view of the retractable screen system of FIG. 1 with the gate in a closed position.

Referring to FIG. 2B, in the first embodiment, the screen 40 further includes a first side portion 46 and a second side portion 48 opposite the first side portion 46. In the first embodiment, the first and second screen side portions 46, 48 are oriented generally perpendicularly to the screen face portion 42. As shown in FIG. 3, the first and second screen side portions 46, 48 each include projections 52, 54 extending therefrom. Projections 52, 54 may be rods, pins, bars, or the like. In the first embodiment, rods 52 and 54 are proximate the top and bottom of the screen 40, respectively. Rods 52, 54 are preferably cylindrical in shape, allowing rods 52, 54 to rotate when positioned in a circular opening.

In one preferred embodiment, a rod (not shown) is attached, typically by welding, to the screen 40 proximate the top 41. Preferably, the rod is stainless steel and extends along a portion of the length and across the middle of the screen 40. The rod adds structural support to the screen 40 and is typically used for screens that are over forty inches in length.

Referring to FIG. 2B, the first and second screen side portions 46, 48 each further include two openings 56, 58. In the first embodiment, the openings 56, 58 are each configured to receive a portion of a cylindrical rod, pin, or bar similar to rods 52, 54. Opening 56 is circular in shape and is configured to permit a cylindrical rod or pin to rotate therein. Opening 58 is in the form of an elongated slot that is configured to permit a rod or pin to move along the length of the slot therein.

Figure 2C:
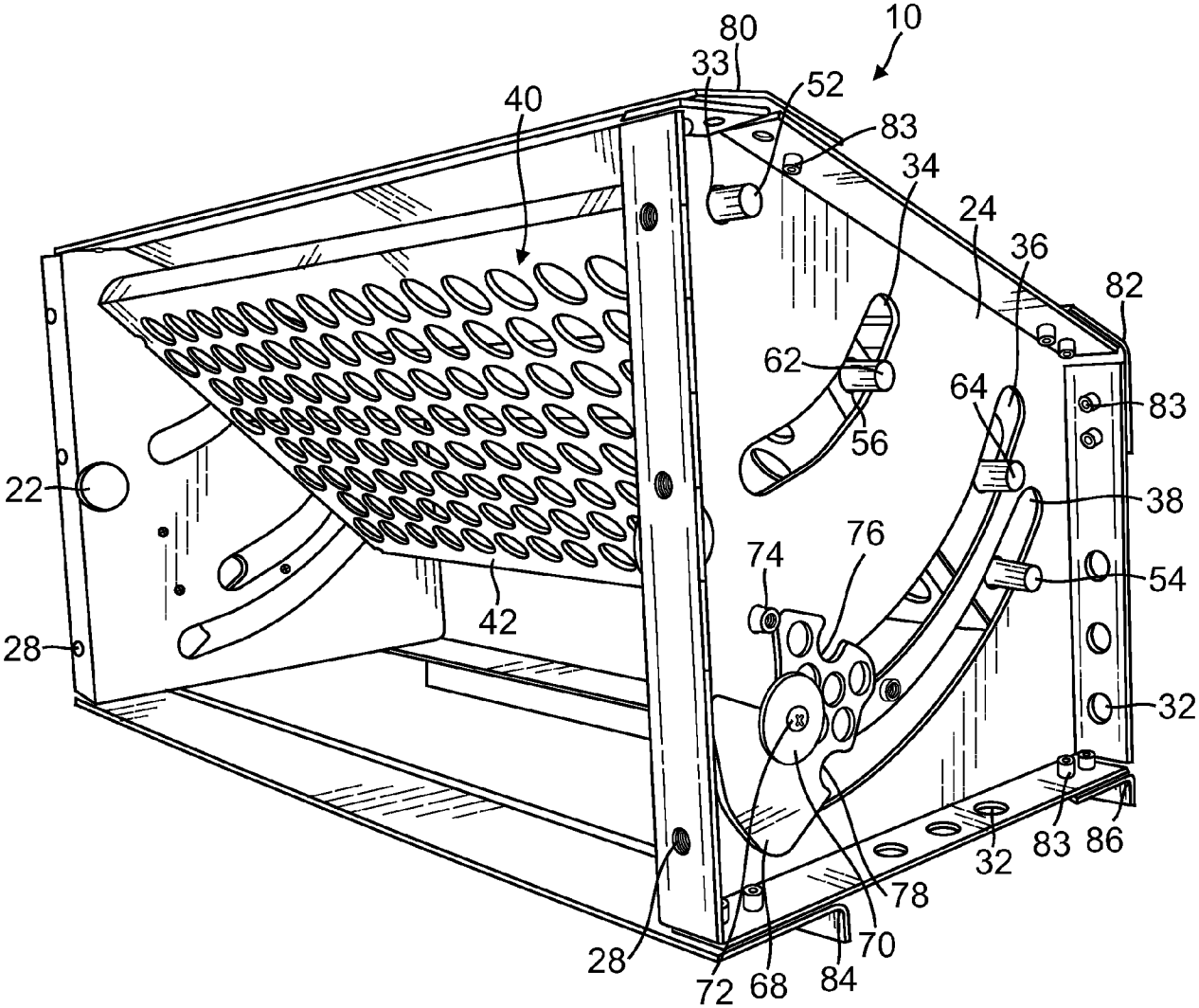
FIG. 2C is a perspective view of the retractable screen system of FIG. 1 with the screen in an open position.

In the first embodiment, as shown in FIG. 2A, the screen 40 is movably coupled to the first and second frame sides 24, 26. Referring to FIG. 2A, rod 52 of each screen side portion 46, 48 passes through a respective opening 33 in the first and second frame sides 24, 26. Rod 54 of each screen side portion 46, 48 passes through a respective slot 38 in the first and second frame sides 24, 26. In the first embodiment, rod 52 is permitted to rotate within opening 33 and rod 54 is permitted to move along the length of slot 38, permitting retractable screen 40 to move between a closed position, as shown in FIG. 2A, and an open position, as shown in FIG. 2C. Preferably retractable screen 40 moves by rotation.

Figure 2D:
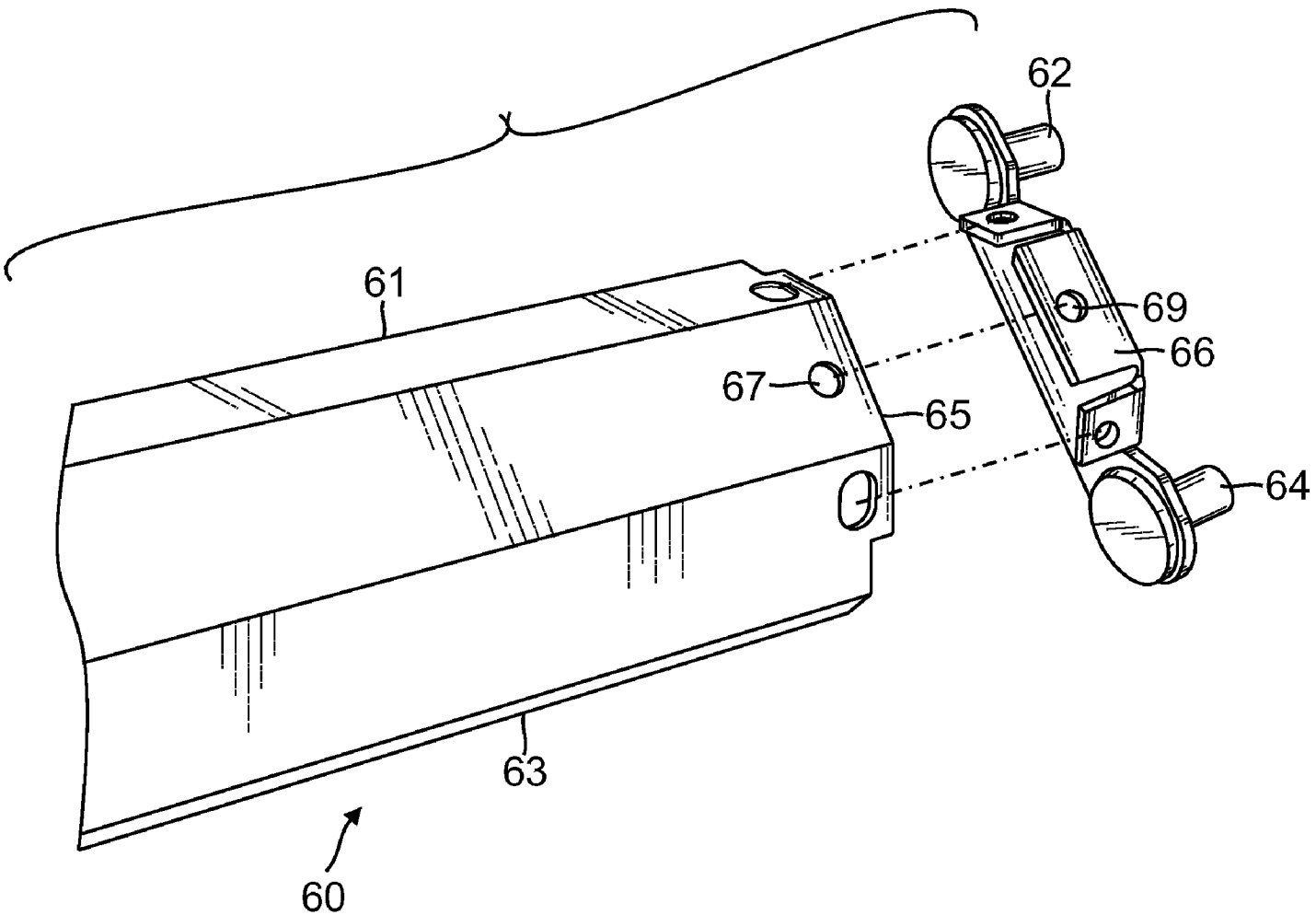
FIG. 2D is an enlarged fragmentary perspective exploded view of a trigger plate of the retractable screen system of FIG. 1.

In the first embodiment, as shown in FIGS. 2D and 5A to 5C, the retractable screen system 10 further includes a trigger plate 60 movably coupled to the screen 40 and extending between the first and second frame sides 24, 26. Preferably, the trigger plate 60 moves by rotation. As shown in FIG. 2D, trigger plate 60 has a top 61, a bottom 63, and sides 65.

Referring to FIGS. 2D and 5A to 5C, in the first embodiment the trigger plate 60 includes rods or pins 62, 64 extending therefrom at each of the trigger plate sides 65. Trigger plate rods 62 each pass through, and are permitted to rotate in, a respective opening 56 in the first and second screen side portions 46, 48. Additionally, trigger plate rods 62 each pass through, and are permitted to move along the length of, a respective slot 34 in the first and second frame sides 24, 26. In the first embodiment, rods 64 of the trigger plate 60 each pass through and are permitted to move along the length of, a respective elongated opening 58 in the first and second screen side portions 46, 48. Additionally, rods 64 of the trigger plate 60 each pass through and are permitted to move along the length of a respective slot 36 in the first and second frame sides 24, 26.

Referring to FIG. 2D, in the first embodiment of the invention, the trigger plate 60 includes a trigger plate end 66 on each side 65 of the trigger plate 60. Typically, openings 69 in the trigger plate end 66 are aligned with openings 67 proximate the side 65 of the trigger plate 60 and three dome rivets (not shown) are used to secure the trigger plate end 66 to the trigger plate 60. Alternatively, the trigger plate ends 66 could be partially or fully welded to the trigger plate 60, eliminating the need for the use of dome rivets. In the preferred embodiment, rods 62, 64 are the projections of a spot weld pin having a circular head that is attached to each trigger plate end 66. Typically, the spot weld pin is a PHZ stainless steel weld pin, and may be for example pins manufactured by The Ohio Nut and Bolt Company. It is to be appreciated that alternatively to the use of a trigger plate end 66, rods, pins, or projections similar to rods 62, 64 could be attached (e.g., by welding) directly to trigger plate 60 to extend from each of the sides 65 of trigger plate 60.

Referring to FIG. 2A, in the first embodiment, retractable screen system 10 further includes a locking gear 68 movably coupled to each of the first and second frame sides 24, 26. It will be understood that in various embodiments, a single locking gear may be used on one of the first and second frame sides 24, 26 or two locking gears may be used, with one locking gear on each of the first and second frame sides 24, 26. For the present example only, two locking gears are illustrated with one locking gear on each of the first and second frame sides 24, 26.

In the first embodiment, the locking gear 68 is rotatably mounted on the first and second frame sides 24, 26 using a combination of a cres washer (not shown), a fender washer 70, and a cres screw 72. Preferably, an adhesive, such as Locktite® red thread locker, is applied to the cres screw 72. The locking gears 68 may be movably coupled to the first and second frame sides 24, 26 using various other fasteners, rivets, pins, or hinges known in the art. The locking gear 68 is permitted to move from a locked position shown in FIG. 2A to an unlocked or fully open position shown in FIG. 2C. Preferably, the locking gear 68 moves by rotation about the shaft of the cres screw 72. Referring to FIG. 2C, in an embodiment, a set pin 74 is provided on each of the first and second frame sides 24, 26 to abut a portion of the locking gear 68 during its rotation to restrict the maximum degree of rotation of the locking gear 68.

Still referring to FIG. 2C, in an embodiment, the locking gear 68 includes a first indentation, recess, or detent 76 and a second indentation, recess, or detent 78. Referring to FIGS. 2A and 5A, when the locking gear 68 is in the locked position, the first recess 76 receives a portion of trigger plate rod 64 and the second recess 78 receives a portion of screen rod 54. With trigger plate rod 64 positioned in the first recess 76, the locking gear 68 is retained in the locked position and prevented from rotating to the unlocked position shown in FIG. 2C. Still referring to FIGS. 2A and 5A, with the locking gear 68 retained in its locked position, screen rod 54 is retained in the second recess 78 and is prevented from moving along the length of slot 38 in the first and second frame sides 24, 26. Accordingly, the screen 40 is locked in the closed position shown in FIG. 2A and is prevented from rotating to the open position shown in FIG. 2C.

In the first embodiment, the locking gear 68 is retained in the locked position and the screen 40 is retained in the closed position during dry periods and periods when water levels are low. This prevents entry of environmental debris, trash and pollutants through the storm drain curb inlet 12 into the catch basin and the storm drain system (not shown). When storm water or ground water rise to a predetermined level, the screen 40 rotates to the open position and permits unimpeded water flow into the catch basin and the storm drain system.

Figure 5B:
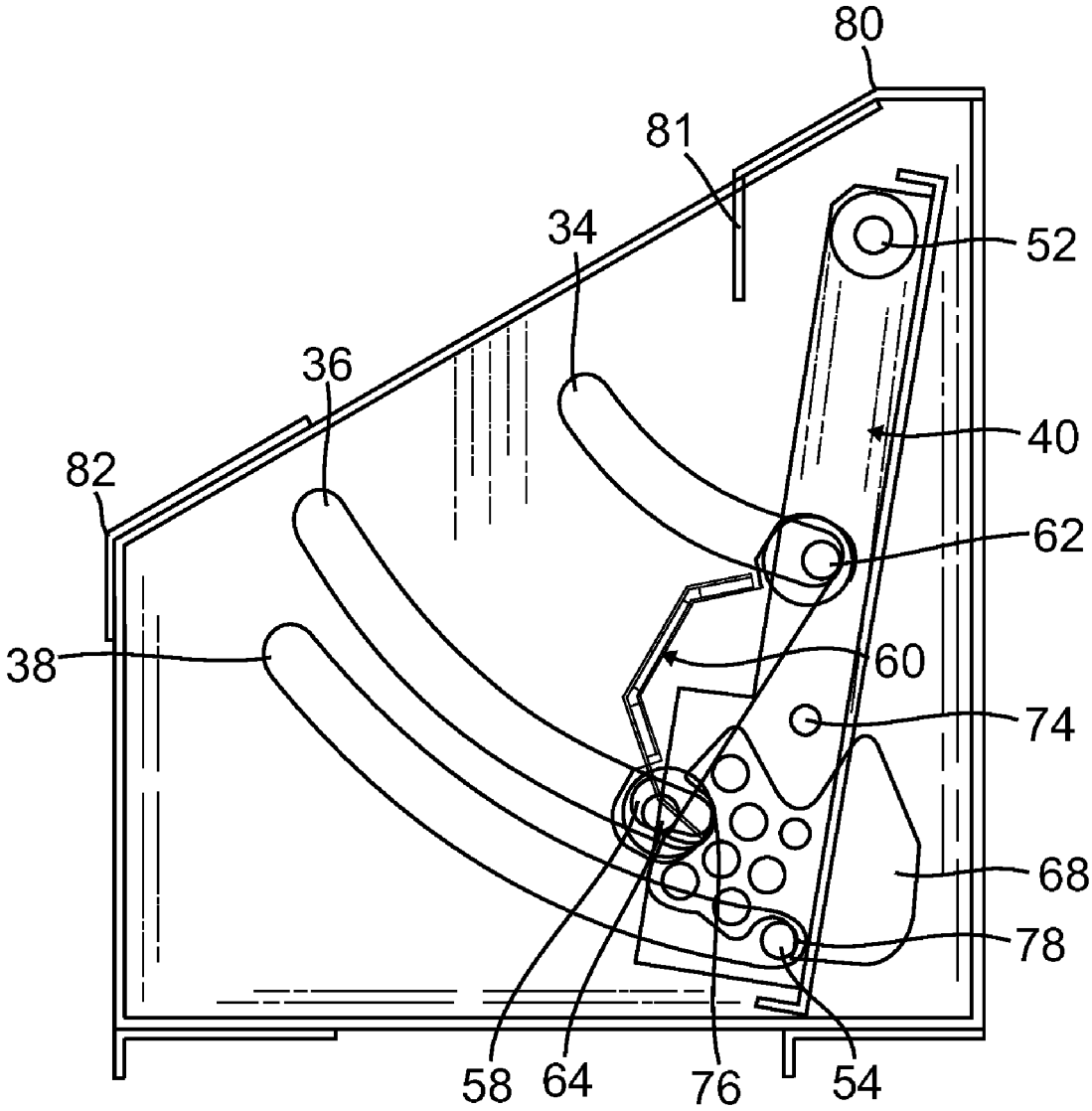
FIG. 5B is a side view of the retractable screen system of FIG. 1 with the screen in a closed position and with the trigger plate in the upward position as when acted upon by water flow.

Specifically, when water rises to a certain level during, for example, a rain storm, water flows through screen openings 44 and onto a portion of the trigger plate 60. The flow of water onto the trigger plate 60 causes the trigger plate 60 to move in a direction that is generally upward and away from screen face portion 42. Referring to FIG. 5B, when the trigger plate 60 moves in response to water flow, trigger plate rods 62 rotate in openings 56 of the screen side portions 46, 48. Additionally, trigger plate rods 64 move along a portion of slots 58 of the screen side portions 46, 48 and along a portion of slot 36 of the first and second frame sides 24, 26.

Still referring to FIG. 5B, in the first embodiment, the movement of trigger plate 60 and, more specifically, the movement of trigger plate rod 64 along frame side slot 36 and screen side slot 58 causes trigger plate rod 64 to move out of the first recess 76 of the locking gear 68 on each of the first and second frame sides 24, 26. With rod 64 out of the first recess 76, the locking gear 68 becomes unlocked and free to move by rotation about the shaft of the screw 72.

Figure 5C:
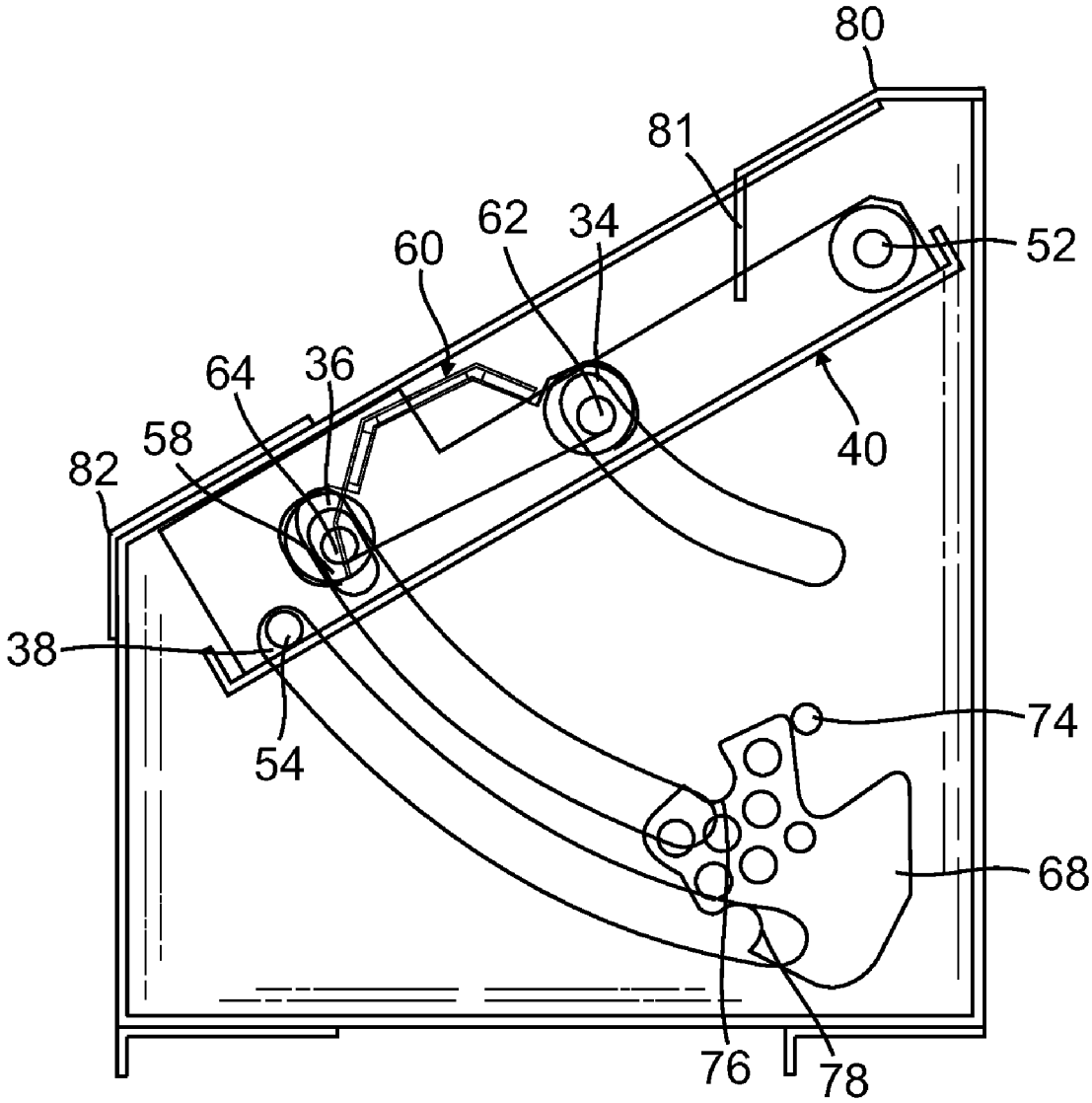
FIG. 5C is a side view of the retractable screen system of FIG. 1 with the screen in a fully open position and with the locking gear being in the unlocked position.
Figure 6A:
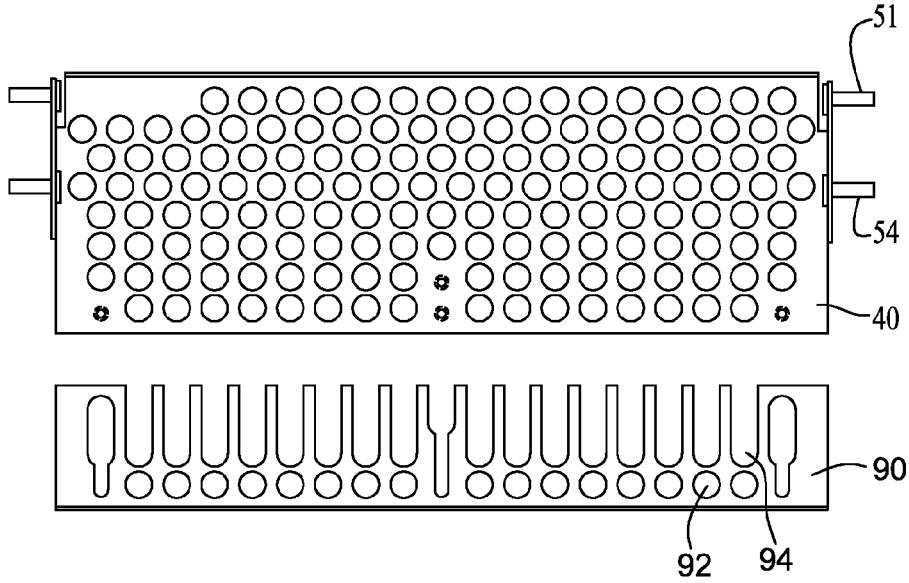
FIG. 6A is an exploded front elevation view of a retractable screen and screen extension according to an embodiment of the present invention.
Figure 6B:
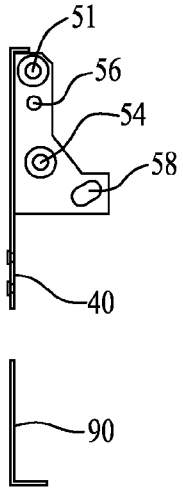
FIG. 6B is a side elevation view of the retractable screen and screen extension of FIG. 6A.
Figure 7A:
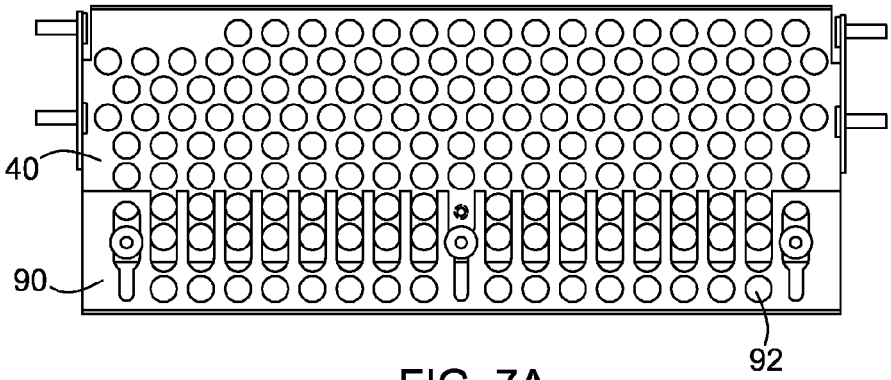
FIG. 7A is a front elevation view of the retractable screen and screen extension of FIG. 6A shown assembled with the screen extension in an extended position.
Figure 7B:
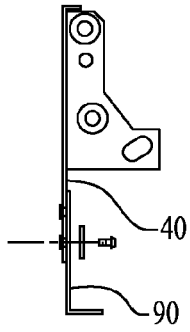
FIG. 7B is a side elevation view of the retractable screen and screen extension of FIG. 7A shown partially assembled.
Figure 8A:
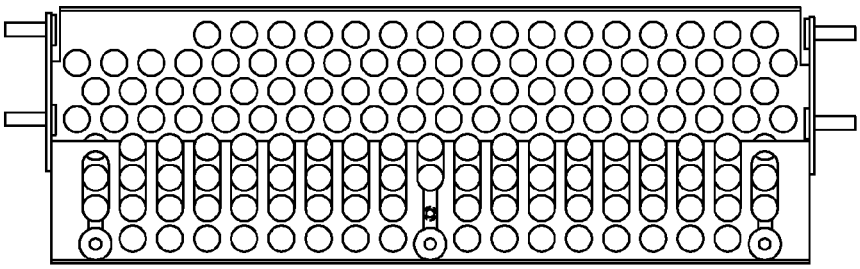
FIG. 8A is a front elevation view of the retractable screen and screen extension of FIG. 6A shown assembled with the screen extension in an unextended position.
Figure 8B:
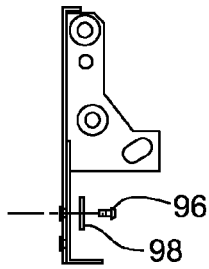
FIG. 8B is a side elevation view of the retractable screen and screen extension of FIG. 8A shown partially assembled.

With locking gear 68 unlocked, the screen 40 rotates from the closed position shown in FIGS. 2A and 5A to the open position shown in FIGS. 2C and 5C. Specifically, when the locking gear 68 is unlocked, screen rods 52 rotate in openings 33 of the first and second frame sides 24, 26. In addition, screen rods 54, which are no longer locked in the second recess 78 of the locking gear 68, are allowed to move in a generally upward direction along the length of slots 38 in the first and second frame sides 24, 26, causing the screen 40 to rotate from the closed position to the open position.

Referring to FIGS. 5B and 5C, during the rotation of the screen 40 from the closed position to the open position, screen rods 54 push on the locking gears 68, causing each of the locking gears 68 to rotate from the locked position shown in FIG. 5A to the open position shown in FIG. 5C until the rotation of the locking gears 68 is stopped by the set pins 74. When the locking gear 68 rotates from the locked position to the unlocked position, the recesses 76, 78 rotate in a generally upward direction. Referring to FIG. 5C, the screen 40 rotatably opens until the screen side portions 46, 48 abut the second top frame member 82. The second top frame member 82 prevents the screen 40 from opening any further. Thus, the position of the second top frame member 82 determines the maximum open position of the screen 40.

When levels of water flowing into the storm drain curb inlet 12 when the screen 40 is open subside, the screen 40 automatically rotates downward into the closed position shown in FIGS. 2A and 5A. As the screen 40 rotates into the closed position, trigger plate rods 62 and 64 and screen rod 54 move in a generally downward direction in slots 34, 36, 38 of the first and second frame sides 24, 26. Referring to FIG. 5C, screen rod 54 contacts and pushes on the second recess 78 of the locking gear 68, causing the locking gear 68 to rotate generally downward from the unlocked position to the locked position shown in FIG. 5A. Referring to FIGS. 5A and 5C, as the locking gear 68 rotates to its locked position and trigger plate rod 64 moves downward in slot 36, trigger plate rod 64 is received in the first recess 76 of the locking gear 68 to again lock the locking gear 68 and prevent the locking gear 68 from rotating into the open position. With the locking gear 68 locked, the screen 40 is again locked in the closed position until water levels rise sufficiently to again move the trigger plate to unlock the screen 40 as described above.

One skilled in the art will recognize that the number of screen rods and trigger plate rods and the corresponding number of recesses in the locking gear may be varied as desired and depending on the materials used for the various components, to vary the water flow needed to cause the gate to open. Additionally, the shape and orientation of recesses in the locking gear and the shape and size of the locking gear may also be varied as desired and depending on the materials used for the various components, to vary the water flow needed to cause the gate to open.

In an embodiment, the screen 40 typically opens when the water level rises to approximately 50% of the curb face 14 shown in FIG. 1. Referring to FIG. 1, the retractable screen system 10 of the present invention is preferably installed such that there is a small gap 11 between the screen bottom 43 and the bottom of the storm drain inlet 12. When water runoff level does not rise to the first row of screen openings 44, water is permitted to flow into the catch basin through the gap 11. In one first embodiment the gap 11 is approximately one half inch.

As shown in FIGS. 6 to 8B, in an additional embodiment, the screen 40 is provided with an adjustable screen extension 90. Preferably, the screen extension 90 has openings 92 that correspond in shape and size to the screen openings 44 so that the extension is not readily apparent upon view from outside the storm drain inlet 12. The screen extension 90 may have a plurality of slots 94 that allow for the screen extension 90 to be movably positioned relative to the screen 40. Preferably, the extension 90 is removably coupled to the screen 40 using a fastener such as a screw 96 in conjunction with a washer 98. The extension 90 is allows for adjustment of the screen size to accommodate differently sized storm drain inlets without having to fabricate many different screen sizes.

Referring to FIGS. 3 and 4, a gap 87 is formed between the bottom 63 of the trigger plate 60 and the bottom 43 of the screen 40. During periods when water levels are low, water can flow through the screen openings 44 and into gap 87 without flowing onto the trigger plate 60. During such periods of low water levels, the trigger plate 60 will not move to unlock the locking gears 68 and the screen 40 will remain locked in the closed position. This prevents environmental debris, trash, and pollutants from entering the catch basin and the storm drain system. It will be understood that the dimensions of the trigger plate 60 may be varied to increase or decrease the gap 87, permitting water to flow onto the trigger plate 60 and cause the screen 40 to open when water levels are less than or greater than 50% of the curb face 14.

Figure 9:
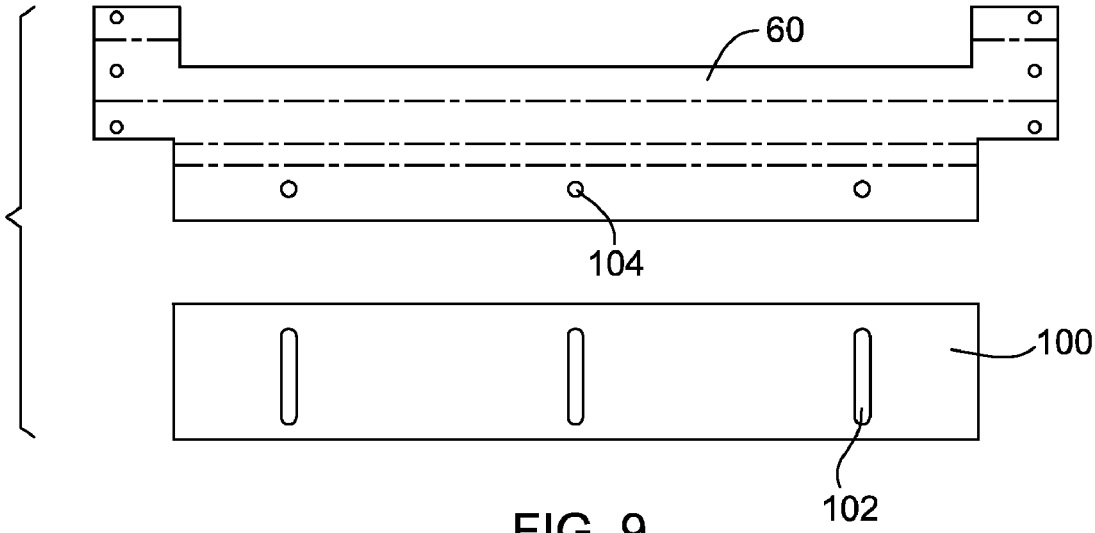
FIG. 9 is an exploded rear elevation view of a trigger plate and trigger plate extension according to an embodiment of the present invention.
Figure 10A:
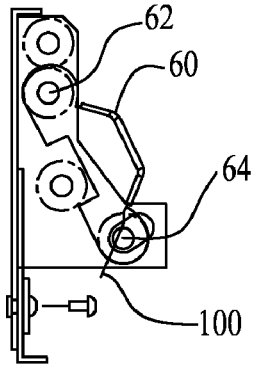
FIG. 10A is a side elevation view of a retractable screen system according to an embodiment of the present invention showing the trigger plate of FIG. 9 with the trigger plate extension in an unextended position.
Figure 10B:
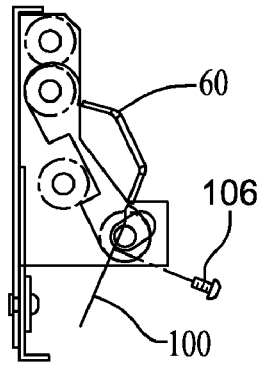
FIG. 10B is a side elevation view of the retractable screen system of FIG. 10B with the trigger plate extension in an extended position.

The shape and orientation of the trigger plate 60 may be varied as desired and depending on the materials used for the various components, to vary the water flow needed to cause the gate to open. In an additional embodiment, as shown in FIGS. 9 to 10B, the trigger plate 60 is provided with an adjustable trigger plate extension 100. Preferably, the trigger plate extension 100 has a plurality of slots 102 that allow for the trigger plate extension 100 to be movably positioned relative to the trigger plate 60 which has a plurality of holes 104 aligned with the slots 102. Preferably, the trigger plate extension 100 is removably coupled to the trigger plate 60 using a fastener, such as a screw 106 placed through the holes 104 and slots 102. In additional embodiments, the trigger plate extension 100 may be welded to the trigger plate 60. The trigger plate extension 100 allows for adjustment of the trigger plate 60 to cause the screen to open at different water levels without the need to fabricate many different trigger plate sizes. Additionally, the trigger plate extension 100 allows for accommodation of different screen sizes, particularly when used in conjunction with a screen 40 having an adjustable screen extension 90.

Referring to FIGS. 2A and 3, in the first embodiment, a gap 88 is formed between the top 41 of the screen face portion 42 and the first top frame member 80. In certain situations, environmental debris, trash, etc. accumulate in front of, or get stuck to, the retractable screen 40, obstructing a significant number, or even most, of the screen openings 44. This obstruction blocks water from flowing through the openings 44 onto the trigger plate 60, thereby preventing the screen 40 from opening. With water not being drained from the street, the water level will continue to rise until it reaches the top of the screen 40. At that point, water will flow into gap 88 and will be deflected by the flange 81 of the first top frame member 80 to flow onto the trigger plate 60, causing the trigger plate 60 to move and the screen 40 to open. Once the screen 40 opens, water and the accompanying debris will flow into the storm drain curb inlet 12.

If environmental debris and trash obstruct screen openings 44 and prevent the screen 40 from opening, but water levels are not high enough for water to flow into gap 88, the retractable screen 40 may be manually opened by inserting a screwdriver or other object sized to fit through one of the screen openings 44. For example, a screw driver may be used to push on the trigger plate 60 causing it to move away from the screen 40, unlocking the locking gear 68 and permitting the screen 40 to rotate to the open position. Once the screen 40 opens, unimpeded flow of water is allowed into the storm drain curb inlet 12 and into the catch basin.

It will be understood that although the retractable screen system 10 is dimensioned to fit over a typical city street storm drain curb inlet, the dimensions of the retractable screen system 10 of the present invention may be varied to accommodate storm water drain inlets of many different sizes. Specifically, the dimensions of the first and second frame sides 24, 26, the screen 40, and the trigger plate 60 may be varied to accommodate the size of almost any storm drain curb inlet. In addition, depending on the size of the storm water inlet, two or more retractable screen systems 10 of the present invention may be installed side by side to cover the entire length of a storm water inlet.

There is disclosed in the above description and the drawing, a retractable screen system for installation across a storm drain inlet which fully and effectively overcomes the disadvantages associated with the prior art. However, it will be apparent that variations and modifications of the disclosed embodiments may be made without departing from the principles of the invention. The presentation of the preferred embodiments herein is offered by way of example only and not limitation, with a true scope and spirit of the invention being indicated by the following claims.

Any element in a claim that does not explicitly state "means" for performing a specified function or "step" for performing a specified function, should not be interpreted as a "means" or "step" clause as specified in 35 U.S.C. §112.

What is claimed is:

1. A retractable screen system for installation across a storm drain inlet, the system comprising:

a frame comprising:

a first side member; and a second side member opposite the first side member, each of the first and second side members comprising a locking gear configured to be reversibly movable from a locked position to an unlocked position;

a retractable screen movably coupled to the first and second frame side members, the screen comprises a plurality of openings and is configured to rotate from a closed position to an open position, at least a portion of the retractable screen being removably engagable with the locking gears, the locking gears preventing the screen from rotating from the closed position to the open position when the locking gears are in the locked position;

a trigger plate movably coupled to the screen, the trigger plate being configured to rotate from a first position to a second position, at least a portion of the trigger plate being removably engagable with the locking gears, the trigger plate preventing the locking gears from moving from the locked position to the unlocked position when the trigger plate is in the first position, the trigger plate being configured to move out of engagement with the locking gears when water flows against a portion of the trigger plate, allowing the locking gears to move from the locked position to the unlocked position and permitting the screen to rotate from the closed position to the open position.

2. The system of claim 1, wherein the trigger plate further comprises a plurality of projections and each of the locking gears includes at least one recess, at least one of the trigger plate projections being retained in the at least one recess to prevent the locking gears from moving from the locked position to the unlocked position when the trigger plate is in the first position.

3. The system of claim 1, wherein the trigger plate and the retractable screen each include a plurality of projections extending therefrom and the first and second frame side members include a plurality of elongated openings therein, at least one of the projections of the trigger plate and at least one of the projections of the retractable screen moving in a generally upward direction in the elongated openings when the retractable screen rotates from the closed position to the open position.

4. The system of claim 3, wherein at least one of the elongated openings includes a curved portion.

5. The system of claim 3, wherein when the screen rotates from the open position to the closed position the screen projections and the trigger plate projections engage the locking gears to lock the screen in the closed position.

6. The system of claim 1, wherein each of the first and second frame side members includes at least one set pin configured to abut a portion of the locking gear to restrict a maximum degree of rotation of the locking gear.

7. The system of claim 1, further comprising a first top member secured to each of the first and second frame side members.

8. The system of claim 7, wherein the first top member includes a flange configured to deflect water flow onto a portion of the trigger plate.

9. The system of claim 8, further comprising a second top member secured to each of the first and second side members, at least a portion of the second top member being configured to abut a portion of the screen when the screen is in a fully open position.

10. The system of claim 1, wherein the trigger plate rotates in a generally upward direction when water flows against a portion of the trigger plate to allow the locking gears to move into the unlocked position.

11. The system of claim 1, wherein the screen further comprises an adjustable screen extension.

12. The system of claim 1 wherein the trigger plate further comprises an adjustable trigger plate extension.

13. A retractable screen system for installation across a storm drain inlet, said system comprising:

a frame comprising a first side and a second side opposite the first side, each of the first and second sides including a locking gear configured to rotate from a locked position to an unlocked position, each of the locking gears including a first recess and a second recess;

a retractable screen rotatably coupled to the first and second frame sides, the screen being configured to rotate from a closed position to an open position, and the retractable screen comprising:

a plurality of openings; and a plurality of projections extending therefrom, at least one of the screen projections being retained in the first recess of each of the locking gears when the screen is in the closed position and the locking gears are in the locked position;

a trigger plate rotatably coupled to the screen, the trigger plate being configured to rotate from a first position to a second position, and the trigger plate having a plurality of projections extending therefrom, separate projections being retained in the second recess of each of the locking gears when the trigger plate is in the first position and the locking gears are in the locked position;

wherein the trigger plate is configured so that when water flows against a portion of the trigger plate, the trigger plate rotates and the projections of the trigger plate move out of the second recess of each of the locking gears, allowing the locking gears to rotate from the locked position to the unlocked position to permit the projections of the screen to move out of the first recess of each of the locking gears and for the screen to rotate from the closed position to the open position.

14. The system of claim 13, wherein the first and second frame sides include a plurality of elongated openings therein, at least one of the projections of the trigger plate and at least one of the projections of the screen moving in a generally upward direction in the elongated openings when the retractable screen rotates from the closed position to the open position.

15. The system of claim 14, wherein at least one of the elongated openings includes a curved portion.

16. The system of claim 13, wherein each of the first and second sides includes at least one aperture configured to receive at least one of the projections of the retractable screen and to permit the at least one of the projections of the retractable screen to rotate therein.

17. The system of claim 13, wherein when the retractable screen rotates from the open position to the closed position, at least one of the projections of the screen move into the first recess of each of the locking gears to lock the retractable screen in the closed position.

18. The system of claim 13, further comprising a first top member secured to each of the first and second frame sides, the top member including a flanged portion configured to deflect water flow onto a portion of the trigger plate.

19. The system of claim 13, wherein said trigger plate rotates in a generally upward direction when water flows against a portion of the trigger plate to allow the locking gears to rotate into the unlocked position.

20. The system of claim 13, wherein the screen further comprises an adjustable screen extension.

21. The system of claim 13 wherein the trigger plate further comprises an adjustable trigger plate extension.

* * * * *